US007224921B2

(12) United States Patent
Iijima et al.

(10) Patent No.: US 7,224,921 B2
(45) Date of Patent: May 29, 2007

(54) IMAGE FORMING APPARATUS CAPABLE OF EFFECTIVELY REMOVING HEATED AIR UNDESIRABLE TO IMAGE REPRODUCTION

(75) Inventors: Yasuaki Iijima, Yokohama (JP); Kenichi Takehara, Machida (JP); Junya Takigawa, Ohta-ku (JP); Keisuke Uchida, Hachioji (JP)

(73) Assignee: Ricoh Company, Ltd., Tokyo (JP)

( * ) Notice: Subject to any disclaimer, the term of this patent is extended or adjusted under 35 U.S.C. 154(b) by 151 days.

(21) Appl. No.: 11/106,441

(22) Filed: Apr. 15, 2005

(65) Prior Publication Data

US 2005/0238380 A1 Oct. 27, 2005

(30) Foreign Application Priority Data

Apr. 16, 2004 (JP) ..... 2004-121415

(51) Int. Cl.
*G03G 21/20* (2006.01)

(52) U.S. Cl. ..... 399/92; 399/94

(58) Field of Classification Search ..... 399/92, 399/94, 91, 320

See application file for complete search history.

(56) References Cited

U.S. PATENT DOCUMENTS 5,560,779 A * 10/1996 Knowles et al. ..... 118/723 MP
2003/0053818 A1* 3/2003 Kimura ..... 399/94
2003/0185584 A1* 10/2003 Hirose et al. ..... 399/92
2003/0231905 A1 12/2003 Uchida et al. ..... 399/267
2005/0271413 A1* 12/2005 Takemura ..... 399/92
2006/0110172 A1 5/2006 Iijima et al.

FOREIGN PATENT DOCUMENTS

JP 8-220952 8/1996
JP 2003-091189 A * 3/2003
JP 2003-323099 A * 11/2003
JP 2004-109356 A * 4/2004
JP 2005-017552 A * 1/2005
JP 2005-091566 A * 4/2005

OTHER PUBLICATIONS

U.S. Appl. No. 11/450,470, filed Jun. 12, 2006, Kadota, et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes an image forming mechanism, a transfer mechanism, a fixing mechanism, and a heat radiation mechanism. The image forming mechanism forms a toner image which is transferred by the transfer mechanism transfers onto a recording sheet and is fixed by the fixing mechanism. The heat radiation mechanism is disposed between the image forming and fixing mechanisms and radiates heat generated by the fixing mechanism. The heat radiation mechanism includes a heat receiving member, a heat radiating member, and a heat conduction member. The heat receiving member receives heat generated by the fixing mechanism. The heat radiating member radiates the heat received by the heat receiving member. The heat conduction member has a thermal conductive property to efficiently conduct the heat from the heat receiving member to the heat radiating member.

13 Claims, 3 Drawing Sheets

IMAGE FORMING APPARATUS CAPABLE OF EFFECTIVELY REMOVING HEATED AIR UNDESIRABLE TO IMAGE REPRODUCTION

BACKGROUND OF THE INVENTION

1. Field of the Invention

The present invention relates to an image forming apparatus, and more particularly to an image forming apparatus which is capable of efficiently removing heated air undesirable to image reproduction.

2. Discussion of the Background

In recent years, image forming apparatuses such as digital copiers, facsimile machines, printers, and the like have been provided with more functions according to the progress of enhancements in speed, digitalization, and colorization. Accordingly, as a side effect, an image forming apparatus is provided with an increased number of components which include those generating heat such as, for example, a polygon motor, a hard disc, etc. On the other hand, one of important requirements to general office machines is the downsizing. Therefore, an image forming apparatus is facing an issue that an increased heat amount is enclosed in a reduced space.

SUMMARY OF THE INVENTION

This patent specification describes a novel image forming apparatus which is capable of efficiently removing heated air undesirable to image reproduction. As one example, a novel image forming apparatus includes an image forming mechanism, a transfer mechanism, a fixing mechanism, and a heat radiation mechanism. The image forming mechanism is configured to form a toner image. The transfer mechanism is configured to transfer the toner image formed by the image forming mechanism onto a recording sheet. The fixing mechanism is configured to fix the toner image to the recording sheet. The heat radiation mechanism is disposed between the image forming mechanism and the fixing mechanism and is configured to radiate heat generated by the fixing mechanism. The heat radiation mechanism includes a heat receiving member, a heat radiating member, and a heat conduction member. The heat receiving member is configured to receive heat generated by the fixing mechanism. The heat radiating member is configured to radiate the heat received by the heat receiving member. The heat conduction member is connected between the heat receiving member and the heat radiating member and is configured to have a thermal conductive property to efficiently conduct the heat from the heat receiving member to the heat radiating member.

The heat conduction member may conduct heat energy by using latent heat of liquid vaporization and condensation.

The heat conduction member may include a relatively high thermal conductive material.

The heat radiation mechanism may further include a first heat insulator arranged at a position to cover the heat conduction member.

The heat radiation mechanism may further include a second heat insulator arranged at a position to cover a first surface of the heat receiving member opposite to a second surface thereof which receives the heat from the fixing mechanism.

The above-mentioned image forming apparatus may further include a heat duct arranged next to the heat conduction member and configured to conduct an air including a water vapor generated during a time the fixing mechanism fixes the toner image to the recording sheet.

This patent specification further describes a novel heat sink device for use in an image forming apparatus and capable of efficiently removing heated air undesirable to image reproduction. As one example, a novel heat sink device includes a heat receiving member, a heat radiating member, and a heat conduction member. The heat receiving member is configured to receive heat generated by a fixing mechanism of the image forming apparatus. The heat radiating member is configured to radiate the heat received by the heat receiving member. The heat conduction member is connected between the heat receiving member and the heat radiating member and is configured to have a thermal conductive property to efficiently conduct the heat from the heat receiving member to the heat radiating member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
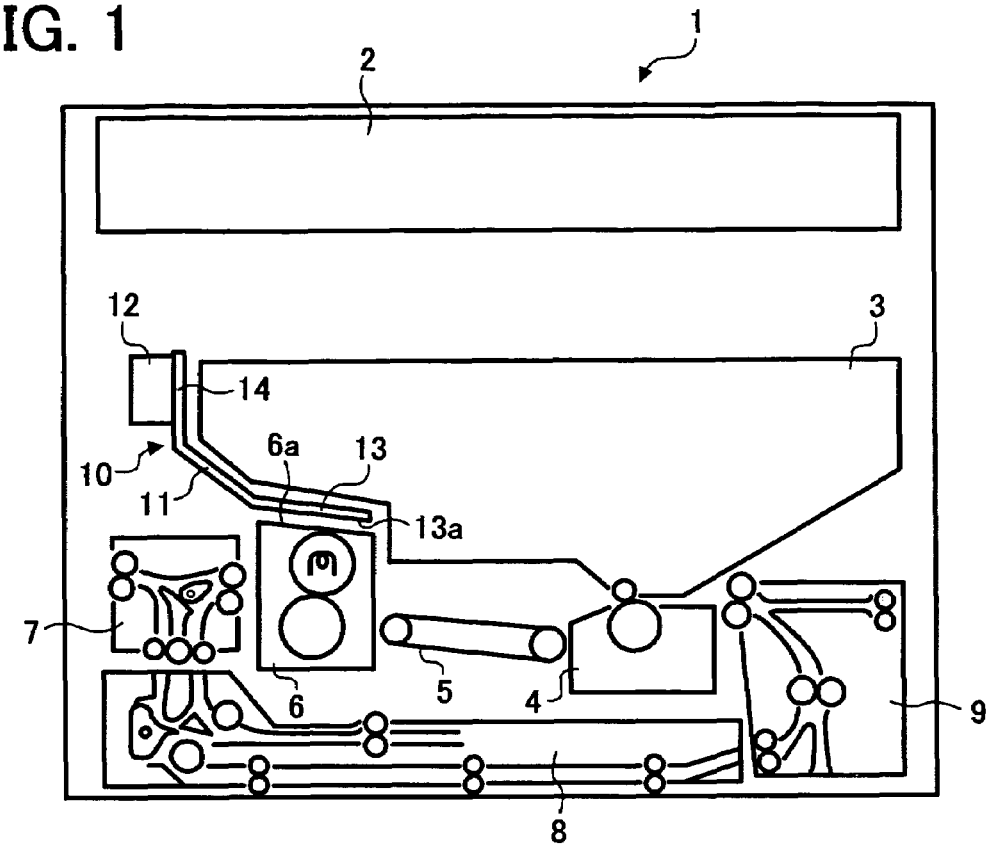
FIG. 1 is a schematic illustration showing an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1 according to a preferred embodiment of the present invention is explained. The image forming apparatus 1 of FIG. 1 includes a scanner unit 2, an image forming unit 3, a transfer unit 4, a transfer belt 5, a fixing unit 6, an ejection unit 7, a duplex unit 8, a sheet feed unit 9, and a heat radiation unit 10.

The scanner 2 is arranged at an upper position of the image forming apparatus 1, and the image forming unit 3 is arranged under the scanner 2. The transfer unit 4, the transfer belt 5, the fixing unit 6, the ejection unit 7, the duplex unit 8, the sheet feed unit 9, and the heat radiation unit 10 are arranged under the image forming unit 3 in a way as illustrated in FIG. 1. More specifically, the sheet feed unit 9, the transfer unit 4, the transfer belt 5, the fixing unit 6, and the ejection unit 7 are arranged in this order from right side in the drawing under the image forming unit 3. The duplex unit 8 is placed at a position under the transfer unit 4, the transfer belt 5, the fixing unit 6, and the ejection unit 7 and adjacent to the sheet feed unit 9.

The image forming unit 3 includes an image carrying member (i.e., a photosensitive member) and a development unit, which are not shown, to carry out an operation of electrophotographic image forming in collaboration with the associated units mentioned above. In some image forming apparatuses, the image forming apparatus may be provided with an intermediate transfer member for intermediately transferring toner images.

With the above-described structure, the image forming apparatus 1 conduct an image forming operation. In the image forming operation, the image forming unit 3 forms a toner image according to the electrophotographic image forming process and conveys it to the image transfer region formed between the image forming unit 3 and the transfer unit 4. In synchronism with the insertion of the toner image into the image transfer region, a recording sheet is also fed to the image transfer region from a sheet cassette (not shown) via the sheet feed unit 9 which is disposed upstream relative to the transfer unit 4. The toner image is transferred from the image forming unit 3 to the recording sheet during the time the recording sheet passes through the image transfer region. The recording sheet having the transferred toner image is further fed to the fixing unit 6 by the transfer belt 5. The recording sheet sent from the fixing unit 6 can be transferred to either one of the ejection unit 7 which ejects the recording sheet outside the apparatus and the duplex unit 8 to print also on the back side of the recording sheet. The duplex unit 8 receives the recording sheet from the ejection unit 7, reverses it and transfers the reversed recording sheet to the sheet feed unit 9 so that the reversed recording sheet is fed to the image transfer region.

Figure 2:
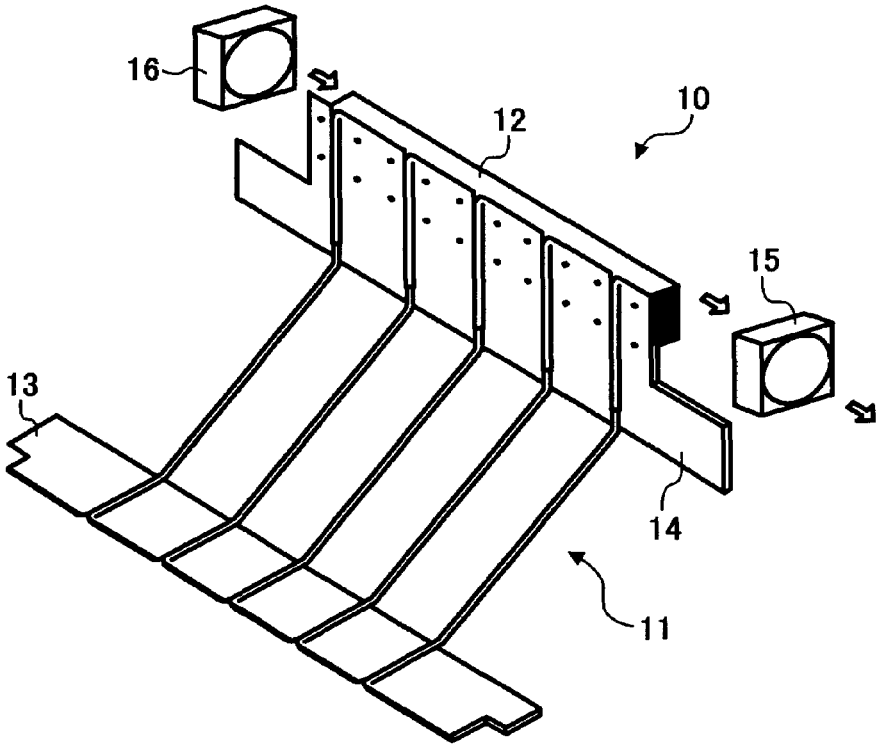
FIG. 2 is a schematic illustration showing a heat radiation mechanism of the image forming apparatus.

FIG. 2 illustrates a structure of the heat radiation unit 10. As illustrated in FIG. 2, the heat radiation unit 10 includes a heat pipe unit 11, a heat sink board 12, a heat receiving plate 13, and a heat radiation plate 14. The heat receiving plate 13 includes a first surface 13*a* (see FIG. 1) which is arranged to face the fixing unit 6 to receive heat directly from an upper surface 6*a* of the fixing unit 6. The heat pipe unit 11 includes a plurality of heat pipes, each of which includes a heat conductive material and is configured to transfer heat. With this structure, the heat generated by the fixing unit 6 is conducted to the heat sink board 12 via the heat receiving plate 13, the heat pipe unit 11, and the heat radiation plate 14.

As also illustrated in FIG. 2, the heat radiation unit 10 is provided with an air-ejection fan unit 15 and a cooling fan unit 16 at positions close to the side edges of the heat sink board 12 and in a heat discharging passage which is indicated by white arrows in FIG. 2. It may alternatively be possible to eliminate one of these fans and to use simply a single fan for discharging the heated air.

The heat radiation unit 10 is, as illustrated in FIG. 1, arranged at a place along a lower side of the image forming unit 3 such that the heat receiving plate 13 is disposed between the image forming unit 3 and the fixing unit 6, that is, the first surface 13*a* of the heat receiving plate 13 faces the upper surface 6*a* of the fixing unit 6. With this structure, heat generated by the fixing unit 6 is discharged from the fixing unit 6 to the heat sink board 12 via the heat pipe unit 11 and the heat radiation plate 14. The surface of the heat sink board 12 is subjected to an air flow generated by the cooling fan unit 16 so that the surface of the heat sink board 12 is cool down and the heat of the heat sink board 12 is transferred by the air flow towards the air-ejection fan unit 15. As a consequence, the heat conveyed from the heat sink board 12 by the air flow is ejected outside the apparatus by the air-ejection fan unit 15. The heat pipe unit 11 is a unit for conducting heat by using latent heat of liquid vaporization and condensation and is capable of rapidly transferring a large amount of thermal energy in response to a relatively small difference of temperature.

Figure 3:
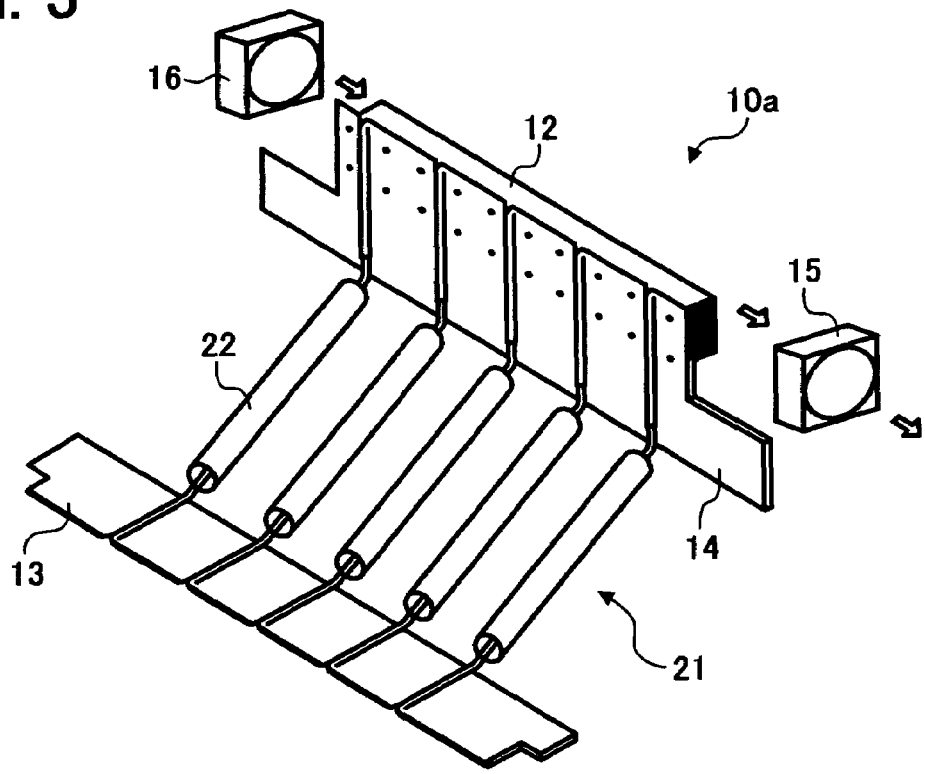
FIGS. 3 and 4 are schematic illustration showing alternative heat radiation mechanisms according to other embodiments of the present invention.

FIG. 3 illustrates a heat radiation unit 10*a*, as an alternative to the heat radiation unit 10 of FIG. 2, according to another embodiment. The heat radiation unit 10*a* of FIG. 3 is similar to the heat radiation unit 10 of FIG. 2, except for a heat pipe unit 21 which replaces the heat pipe unit 11. The heat pipe unit 21 is similar to the heat pipe unit 11, except for a plurality of heat insulators 22. That is, each of the plurality of heat pipes is covered by one of the plurality of heat insulators 22. The plurality of heat insulators 22 protect heat application to the plurality of heat pipes from other heat source than the fixing unit 6.

Figure 4:
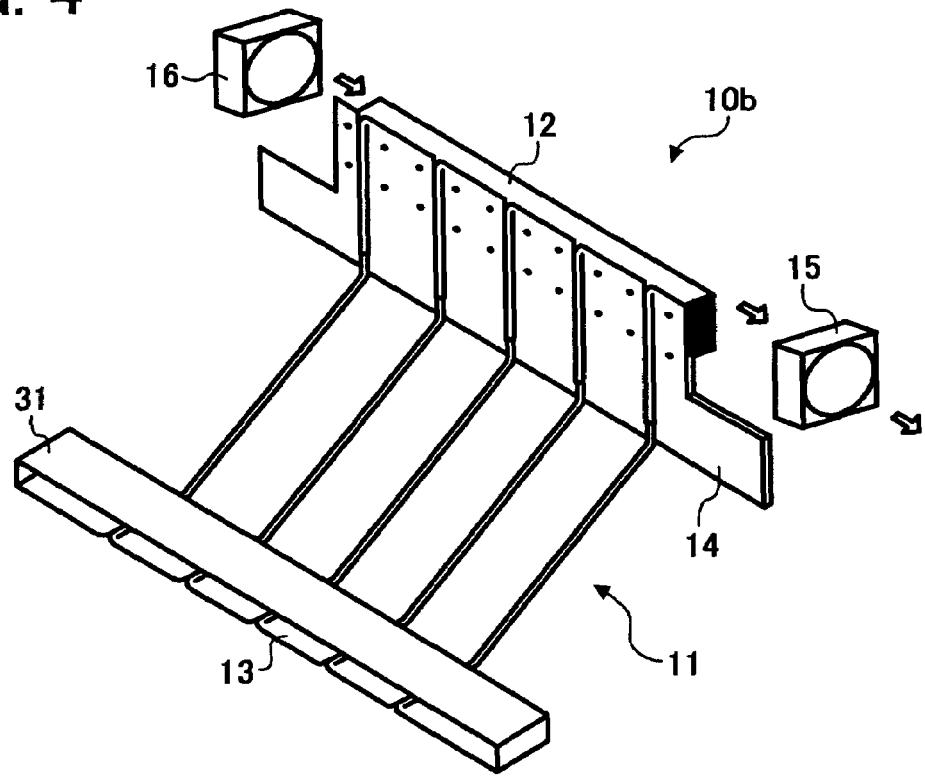

FIG. 4 illustrates a heat radiation unit 10*b*, as another alternative to the heat radiation unit 10 of FIG. 2, according to another embodiment. The heat radiation unit 10*b* of FIG. 4 is similar to the heat radiation unit 10 of FIG. 2, except for a heat insulator 31 for increasing heat conduction efficiency of the heat receiving plate 13 that receives heat from the fixing unit 6 and transmits the heat to the heat pipe unit 11. As illustrated in FIG. 4, the heat insulator 31 is disposed to a second surface of the heat receiving plate 13 opposite to the first surface thereof. The heat insulator 31 avoids heat conduction to the heat receiving plate 13 from other heat source than the fixing unit 6. The heat insulator 31 also avoids heat radiation to other places than to the heat pipe unit 11.

Figure 5:
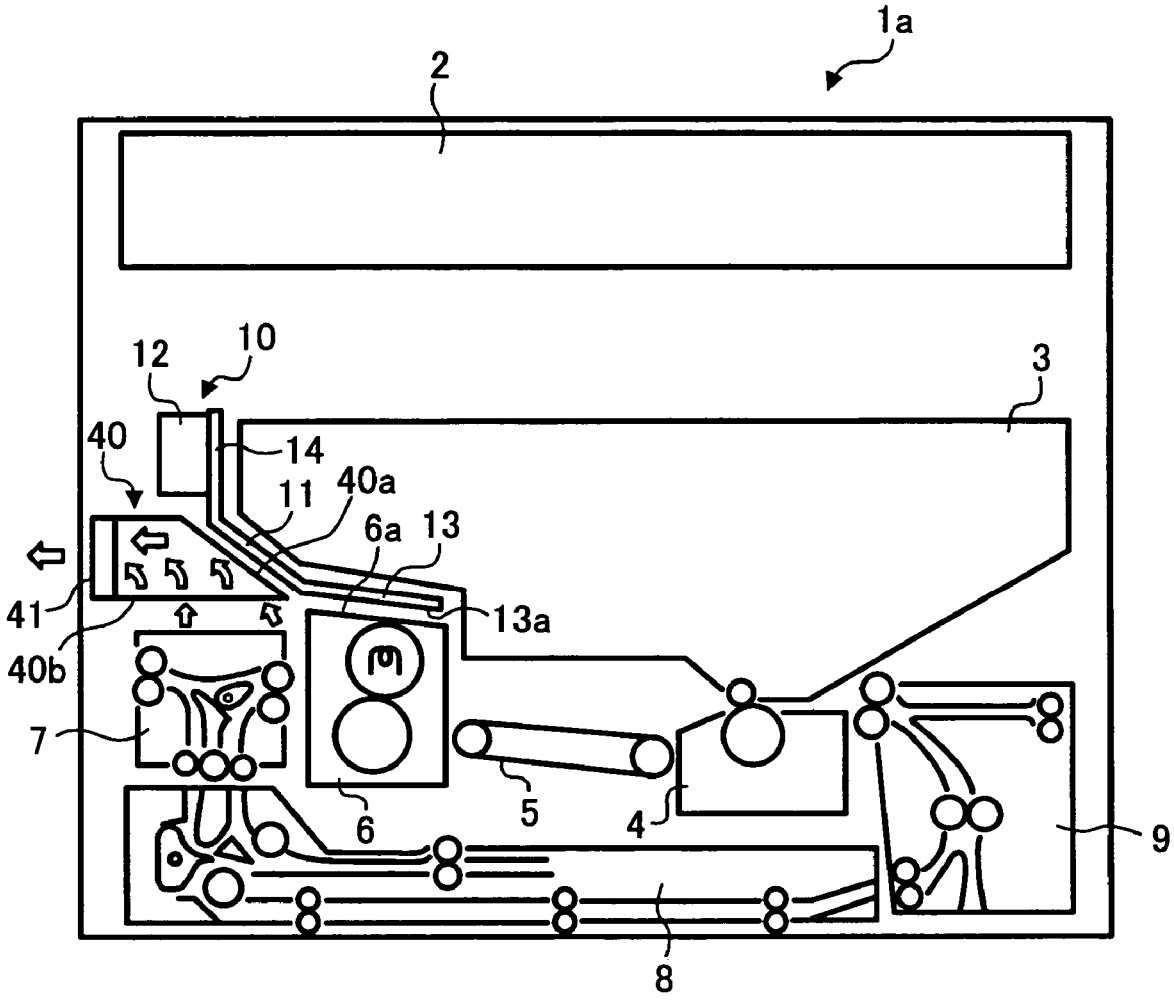
FIG. 5 is a schematic illustration showing an image forming apparatus according to another embodiment of the present invention.

FIG. 5 illustrates an image forming apparatus 1*a* according to another embodiment of the present invention. The image forming apparatus 1*a* of FIG. 5 is similar to the image forming apparatus 1 of FIG. 1, except for a vapor duct 40. As illustrated in FIG. 5, the vapor duct 40 is arranged above the ejection unit 7 and next to the heat radiation unit 10. More specifically, the vapor duct 40 has a wall 40*a* and is arranged such that the wall 40*a* is disposed at a place below and adjacent to the heat pipe unit 11 of the heat radiation unit 10. In addition, the vapor duct 40 includes an opening 40*b* which is arranged above the ejection unit 7 and a vapor ejection fan 41 which is arranged at an outer end of the vapor duct 40.

This structure with the vapor duct 40 absorbs the water vapor generated during the time the recording sheet with a toner image passes through the fixing unit 6 and caused to ascend after the fixing process, thereby avoiding exposure of the heat pipe unit 11 to the heat air and the water vapor. In this way, the heat pipe unit 11 is protected from a heat application from other heat sources than the heat receiving plate 13 of the heat radiation unit 10.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2004-121415 filed on Apr. 16, 2004, in the Japanese Patent Office, the entire contents of which are incorporated by reference herein.

What is claimed is:

1. An image forming apparatus, comprising:

an image forming mechanism configured to form a toner image;

a transfer mechanism configured to transfer the toner image formed by the image forming mechanism onto a recording sheet;

a fixing mechanism configured to fix the toner image to the recording sheet; and a heat radiation mechanism disposed between the image forming mechanism and the fixing mechanism and configured to radiate heat generated by the fixing mechanism, the heat radiation mechanism comprising:

a heat receiving member configured to receive heat generated by the fixing mechanism and arranged to face the fixing mechanism;

a heat radiating member configured to radiate the heat received by the heat receiving member; and a heat conduction member connected between the heat receiving member and the heat radiating member and configured to have a thermal conductive property to efficiently conduct the heat from the heat receiving member to the heat radiating member, the heat conduction member arranged to not face the fixing mechanism.

2. An image forming apparatus of claim 1, wherein the heat conduction member conducts heat energy by using latent heat of liquid vaporization and condensation.

3. An image forming apparatus of claim 1, wherein the heat conduction member includes a relatively high thermal conductive material.

4. An image forming apparatus of claim 1, where the heat radiation mechanism further comprises:

a first heat insulator arranged at a position to cover the heat conduction member.

5. An image forming apparatus of claim 4, wherein the heat radiation mechanism further comprises:

a second heat insulator arranged at a position to cover a first surface of the heat receiving member opposite to a second surface thereof which receives the heat from the fixing mechanism.

6. An image forming apparatus of claim 1, further comprising:

a heat duct arranged next to the heat conduction member and configured to conduct an air including a water vapor generated during a time the fixing mechanism fixes the toner image to the recording sheet.

7. An image forming apparatus, comprising:

image forming means for forming a toner image;

transferring means for transferring the toner image formed by the image forming means onto a recording sheet;

fixing means for fixing the toner image to the recording sheet; and heat radiating means for radiating heat generated by the fixing means, the heat radiating means comprising:

heat receiving means for receiving heat generated by the fixing means and arranged to face the fixing means;

heat radiating means for radiating the heat received by the heat receiving means; and heat conduction means for conducting the heat from the heat receiving means to the heat radiating means, the heat conduction member arranged to not face the fixing means.

8. An image forming apparatus of claim 7, wherein the heat conduction means conducts heat energy by using latent heat of liquid vaporization and condensation.

9. An image forming apparatus of claim 7, wherein the heat conduction means includes a relatively high thermal conductive material.

10. An image forming apparatus of claim 7, where the heat radiating means further comprises:

first heat insulating means for avoiding heat application to the heat conduction member from other heat sources than the fixing means via the heat receiving means.

11. An image forming apparatus of claim 10, wherein the heat radiating means further comprises:

second heat insulating means for avoiding heat application to the heat receiving means from other heat sources than the fixing means.

12. An image forming apparatus of claim 7, further comprising:

heat guiding means for guiding an air including a water vapor generated during a time the fixing means fixes the toner image to the recording sheet.

13. A heat sink device for use in an image forming apparatus, the heat sink device comprising:

a heat receiving member configured to receive heat generated by a fixing mechanism of the image forming apparatus and arranged to face the fixing mechanism;

a heat radiating member configured to radiate the heat received by the heat receiving member; and a heat conduction member connected between the heat receiving member and the heat radiating member and configured to have a thermal conductive property to efficiently conduct the heat from the heat receiving member to the heat radiating member, the heat conduction member arranged to not face the fixing mechanism.

* * * * *